US006554591B1

(12) United States Patent
Dai et al.

(10) Patent No.: US 6,554,591 B1
(45) Date of Patent: Apr. 29, 2003

(54) MICROPUMP INCLUDING BALL CHECK VALVE UTILIZING CERAMIC TECHNOLOGY AND METHOD OF FABRICATION

(75) Inventors: Xunhu Dai, Gilbert, AZ (US); Anthony M. Pavio, Paradise Valley, AZ (US); Ross A. Miesem, Albuquerque, NM (US)

(73) Assignee: Motorola, Inc., Schaumburg, IL (US)

( * ) Notice: Subject to any disclaimer, the term of this patent is extended or adjusted under 35 U.S.C. 154(b) by 10 days.

(21) Appl. No.: 09/994,144

(22) Filed: Nov. 26, 2001

(51) Int. Cl.[7] ..... F04B 7/00; F04B 39/08

(52) U.S. Cl. ..... 417/505; 137/512; 251/367; 251/82; 251/129.14; 156/89.11; 156/89.12; 417/413.2; 417/413.3

(58) Field of Search ..... 156/89.11, 89.12; 417/413.2, 413.3, 505, 297, 298; 251/367, 82, 124.14; 137/512

(56) References Cited

U.S. PATENT DOCUMENTS

| | | | | | |
|---|---|---|---|---|---|
| 6,109,889 | A | * | 8/2000 | Zengerle et al. | 417/413.2 |
| 6,261,066 | B1 | * | 7/2001 | Linnemann et al. | 417/53 |
| 6,262,519 | B1 | * | 7/2001 | Furlani et al. | 310/358 |
| 6,368,079 | B2 | * | 4/2002 | Peters et al. | 417/413.2 |
| 2002/0174936 | A1 | * | 11/2002 | Burdon et al. | 156/89.12 |
| 2002/0174937 | A1 | * | 11/2002 | Burdon et al. | 156/89.12 |

* cited by examiner

*Primary Examiner*—Charles G. Freay
*Assistant Examiner*—William H. Rodriguez
(74) *Attorney, Agent, or Firm*—William E. Koch

(57) ABSTRACT

A multilayer ceramic micropump including a monolithic ceramic package formed of a plurality of ceramic layers defining therein an integrated first ball check valve, and a second ball check valve in microfluidic communication with the first ball check valve, and an actuator characterized as actuating a pumping motion, thereby pumping fluids through the first ball check valve and the second ball check valve.

14 Claims, 1 Drawing Sheet

MICROPUMP INCLUDING BALL CHECK VALVE UTILIZING CERAMIC TECHNOLOGY AND METHOD OF FABRICATION

FIELD OF THE INVENTION

The present invention pertains to micropumps, and more particularly to a micropump including a ball check valve formed utilizing multi-layer ceramic technology for improved size and performance benefits.

BACKGROUND OF THE INVENTION

Laminated ceramic components containing miniature channels and other features, also referred to as microsystems, which utilize low pressure lamination ceramic technology, are currently being developed for use in microfluidic management systems. Of interest is the development of microsystems based on this multilayer ceramic platform in which highly integrated functionality is key. Monolithic structures formed of these laminated ceramic components provide for three-dimensional structures that are inert and stable to chemical reactions and capable of tolerating high temperatures. In addition these structures provide for miniaturization of component parts, with a high degree of electronic circuitry or components embedded or integrated into such a ceramic structure for system control and functionality. Potential applications for these integrated devices include fluidic management in micro-channel devices for life sciences and portable fuels cell applications. One application in particular is the use of ceramic materials to form microchannels and cavities within a ceramic structure thereby defining a micropump and miniaturized valves. Currently, micropumps are provided for use but require positioning on an exterior of a ceramic package, thereby utilizing valuable circuitry real estate.

Mechanical pumps including ball check valves have been developed for use in conjunction with many devices. Many of these mechanical pump devices are cumbersome and complex consisting of several discrete components connected together with plumbing and hardware to produce the pump device. Accordingly, these types of mechanical pumps including ball check valves have not been found suitable for portable ceramic technology applications, or in other applications requiring minimal size and weight. In an attempt to miniaturize and integrate components for use in current microsystem technologies, there exists a need for a micropump including a ball check valve that provides for integration with a ceramic laminate structure. By integrating the micropump, or a portion of the micropump into the ceramic laminate materials, the surface area of the ceramic device can be utilized for other components, such as electrical interconnects or the like. To date, no micropump including a ball check valve has been developed utilizing ceramic monolithic structures in which the miniaturization and integration of the pump has been achieved.

Accordingly, it is an object of the present invention to provide for an integrated multilayer ceramic micropump that provides for microfluidic management of a device.

It is yet another object of the present invention to provide for an monolithic integrated multilayer ceramic micropump structure for the pumping of fluids through a multilayer ceramic structure.

It is still another object of the present invention to provide for a monolithic ceramic micropump structure that is formed utilizing ceramic technology, thereby providing for the integration of a plurality of integrated components defining a micropump including a ball check valve.

It is another object of the present invention to provide for an integrated multilayer ceramic micropump, that is miniaturized for use in conjunction with microsystem technologies.

SUMMARY OF THE INVENTION

The above problems and others are at least partially solved and the above purposes and others are realized in a multilayer ceramic integrated micropump including a ball check valve. The integrated micropump is formed utilizing multilayer ceramic technology, in which the micropump is integrated into the ceramic structure. The integrated micropump includes a fluid inlet, a fluid outlet, a fluid inlet cavity, a fluid outlet cavity, a cofired ball enclosed within each of the cavities, and a means for moving the fluid through the, components.

BRIEF DESCRIPTION OF THE DRAWINGS

The novel features believed characteristic of the invention are set forth in the claims. The invention itself, however, as well as other features and advantages thereof will be best understood by reference to detailed descriptions which follow, when read in conjunction with the accompanying drawings, wherein:

DESCRIPTION OF THE PREFERRED EMBODIMENTS

Figure 1:
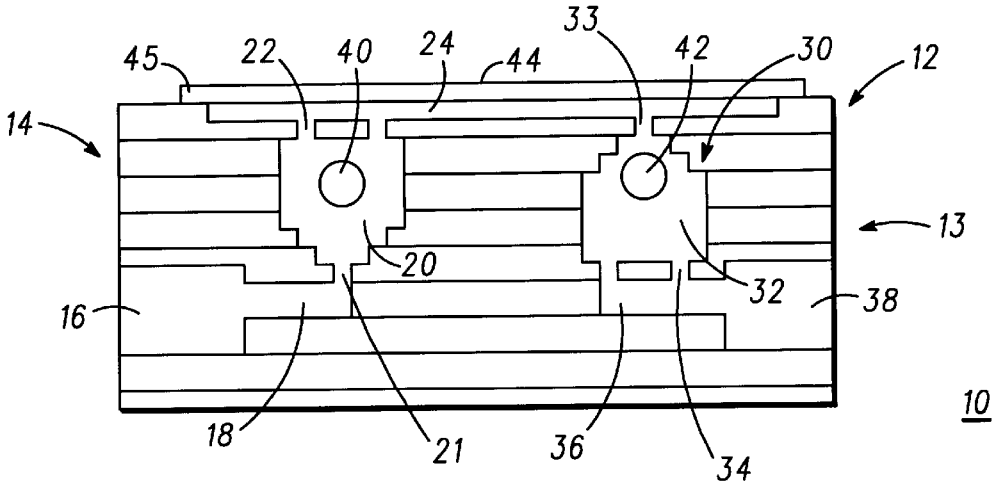
FIG. 1 is a simplified sectional view of a micropump with ball check valve according to the present invention.
Figure 2:
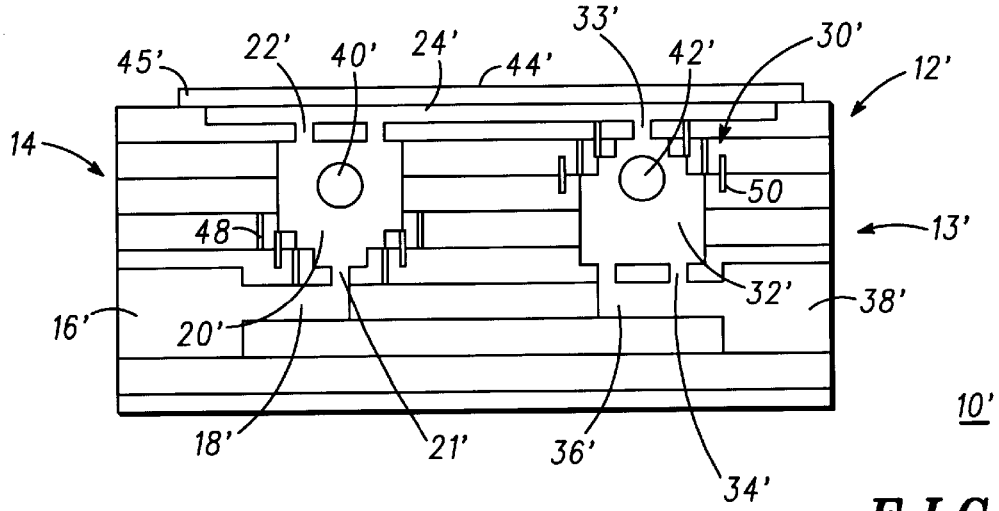
FIG. 2 is a simplified sectional view of an alternative embodiment of a micropump with ball check valve according to the present invention.
Figure 3:
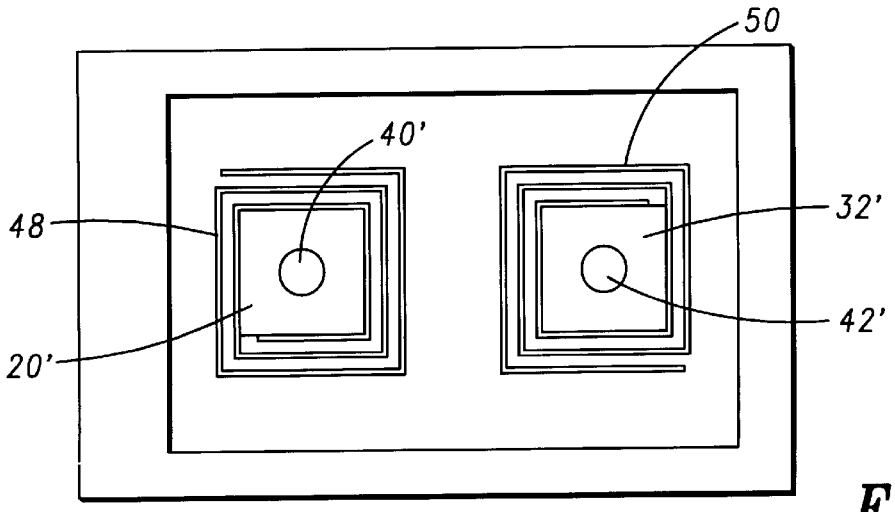
FIG. 3 is a simplified sectional plan view of the micropump with ball check valve taken through line 3—3 of FIG. 2 according to the present invention.

The present invention can be best understood with reference to FIGS. 1–3. In FIGS. 1–3 a micropump including a first ball check valve and a second ball check valve is provided. In the illustrated embodiments, the device is comprised from a plurality of stacked layers of green ceramic tape, which upon firing, sinter into a dense block of ceramic material called a fired package. FIGS. 1–3 will all show fired packages in which the individual layers of green tape ceramic will not be shown.

Turning now to the drawings, and in particular FIG. 1, illustrated in simplified sectional view is a micropump including a plurality of ball check valves, referenced 10, according to the present invention. Micropump 10 is comprised of a plurality of ceramic layers 12, that once fired, sinter into a single device or package 13, as illustrated in FIG. 1. Device 10 has integrated and defined therein a first ball check valve 14 and a second ball check valve 30. First ball check valve 14 includes a fluid inlet channel 16. Fluid inlet channel 16 provides for the intake of fluid into device 10. A first microchannel 18 is provided in microfluidic communication with fluid inlet channel 16. It should be understood that anticipated by this disclosure is the combination of fluid inlet channel 16 and first microchannel 18, thereby providing for fewer component structures, or defined channels, within device 10.

First microchannel 18 provides for fluidic communication between fluid inlet channel 16 and an inlet fluid cavity 20. There is provided in fluidic communication with inlet fluid cavity 20, a plurality of second microchannels 22 (discussed presently) that provide for the outake of fluid from inlet fluid cavity 20 during operation of micropump 10. Second microchannels 22 are in communication with a third microchannel 24 through which the pumped fluid flows from first ball check valve 14, to second ball check valve 30. Second ball check valve 30 includes an outlet fluid cavity 32. A plurality of third microchannels 34 provide for the movement of the pumped fluid from outlet fluid cavity 32 to a fourth microchannel 36, and subsequently into a fluid outlet channel 38. Again, it should be understood that anticipated by this disclosure is the combination of fourth microchannel 36 and fluid outlet channel 38, thereby providing for fewer component structures within device 10. In this particular embodiment second microchannels 22 of first ball check valve 14 and third microchannels 34 of second ball check valve 30 are formed to prevent the blockage of microchannels 22 and 34 by a ball (described presently) encompassed therein cavities 20 and 32 as illustrated.

The previously described plurality of microchannels of device 10 are formed in the plurality of ceramic layers 12 so as to three-dimensionally integrate the microchannel functions. More specifically, ceramic layers 12 are comprised of a composite of any powdered ceramic material dispersed in an organic binder, normally a thermal plastic. This organic binder provides the starting "green sheet" material which can be handled much like a sheet of paper. Microchannels 16, 18, 22, 24, 34, 36, and 38, and cavities 20 and 32 are formed by mechanically punching or laser drilling into each individual ceramic layer 12 to define these areas. It should additionally be understood that emerging technologies can be utilized to form these internal structures into ceramic layers 12, such as through the use of fugitive materials thereby forming the internal cavities and channels. During fabrication, a first cofired ball 40 is placed within inlet fluid cavity 20, and a second cofired ball 42 is placed within outlet fluid cavity 32.

First and second cofired balls 40 and 42 in this particular embodiment are formed approximately 5–80 mils in diameter, with a preferred diameter of approximately 20 mils. First and second cofired balls 40 and 42 are formed of a material that is stable to chemical reactions at 900° C., thereby remaining unaffected by the sintering process (discussed presently). Materials suitable for first and second cofired balls 40 and 42 are any stable ceramic material, such as alumina (ruby) ($Al_2O_3$), or zirconia ($ZrO_2$), or stainless steel, a permanent magnet material, or the like. First and second cofired balls 40 and 42 are fabricated to provide for a surface area having minimal contact between the surfaces of first cofired ball 40 and the surfaces of cavity 20, and the surfaces of second cofired ball 42 and the surfaces of cavity 32.

As illustrated, cavities 20 and 32 are formed in ceramic layers 12 to define a pyramid-like structure within ceramic layers 12, and more particularly package 13. A pyramid-like structure is desired to provide for the movement of first cofired ball 40 within a neck portion 21 of cavity 20 and movement of second cofired ball 42 within a neck portion 33 of cavity 32 thereby stopping the flow of fluid when necessary through cavities 20 and 32, and thus micropump 10. This provision to allow for the movement of first and second cofired balls 40 and 42 within cavities 20 and 32 respectfully, provides for one aspect of the operational portion of ball check valves 14 and 30 of micropump 10.

Once channels 16, 18, 22, 24, 34, 36, and 38, and cavities 20 and 32 are formed in ceramic layers 12 and balls 32 and 34 are positioned respectively into cavity 20 and cavity 32, the plurality of ceramic layers 12 are laminated together to form package 13. Typically, each layer is inspected prior to this laminating process. A low pressure lamination process is used on the stack of processed ceramic layers without collapsing channels 16, 18, 22, 24, 34, 36, and 38, and cavities 20 and 32 formed in ceramic layers 12. This laminating process forms a monolithic structure. Next, the monolithic structure is fired, or sintered, at a temperature that is less than the temperature at which first and second cofired balls 40 and 42 become unstable. More specifically, sintering at a temperature of approximately 850–900° C. is performed, whereby the organic materials are volatilized and the monolith becomes a three-dimensional functional ceramic package. It should be understood that first and second cofired balls 40 and 42 are cofired with the ceramic layers 12, and that no separate firing step is required prior to the placement of first and second cofired balls 40 and 42 within cavities 20 and 32, respectively. Subsequent to the sintering process, first and second cofired balls 40 and 42 remain separate from cavities 20 and 32, and are therefore capable of movement within cavities 20 and 32 as described herein, during operation of micropump 10.

There is included as a part of micropump 10, an actuator 44 which provides for the pumping action of micropump 10. In this particular embodiment, actuator 44 is described as a piezoelectric actuation element 45, being either unimorph or bimorph in design. Operation of micropump 10 occurs with the actuation of piezoelectric actuation element 45. More specifically, during operation piezoelectric actuation element 45 in response to a voltage exerted thereon, moves up and down, thereby creating a pumping action and forcing fluid through first ball check valve 14 and second ball check valve 30. When element 45 moves downward with a force, first cofired ball 40 is forced by the movement of the forced fluid into neck portion 21 of cavity 20, thereby closing valve 14 and second cofired ball 42 moves out of neck portion 33 of cavity 32 by the forced fluid, thereby opening valve 30. This movement provides for the stopping of intake fluid into cavity 20 and the movement of fluid in the system out through fluid outake channel 38. In the alternative, when element 45 moves upward, first cofired ball 40 moves out of neck portion 21 of cavity 20, thereby opening valve 14, and second cofired ball 42 is forced into neck portion 33 of cavity 32, thereby closing valve 30. This pumping action provides for the movement, or forcing, of fluid through micropump 10. As described, micropump 10 operates with passive valves, in that the movement of first and second cofired balls 40 and 42 within cavities 20 and 32, respectively, are dependent upon the movement of fluid through the plurality of channels.

Referring now to FIGS. 2 and 3, illustrated is a simplified sectional view and a sectional plan view of a second embodiment of a micropump according to the present invention. More particularly, illustrated is a micropump including a plurality of integrated ball check valves, referenced 10', according to the present invention. It should be noted that all components of FIGS. 2 and 3 that are similar to the components illustrated in FIG. 1, are designated with similar numbers, having a prime added to indicate the different embodiment. In this particular embodiment, micropump 10' is fabricated with the inclusion of active valves, which will be described herein.

In this particular embodiment, micropump 10' is comprised of a plurality of ceramic layers 12', that once fired, sinter into a single device or package 13', as illustrated in FIG. 2. Device 10' has defined therein a plurality of ball check valves. A first ball check valve 14' includes a fluid inlet channel 16'. Fluid inlet channel 16' provides for the intake of fluid into device 10'. A first microchannel 18' is provided in microfluidic communication with fluid inlet channel 16'. It should be understood that anticipated by this disclosure is the combination of fluid inlet channel 16' and a first microchannel 18', thereby providing for fewer component structures within device 10'.

First microchannel 18' provides for fluidic communication between fluid inlet channel 16' and an inlet fluid cavity 20'. There is provided in fluidic communication with inlet fluid cavity 20', a plurality of second microchannels 22' (discussed presently) that provide for the outake of fluid from inlet fluid cavity 20' during operation of micropump 10'. Second microchannels 22' are in communication with a third microchannel 24' through which the pumped fluid flows from first ball check valve 14', to a second ball check valve 30'. Second ball check valve 30' includes an outlet fluid cavity 32'. A plurality of third microchannels 34' provide for the movement of the pumped fluid from outlet fluid cavity 32' to a fourth microchannel 36', and subsequently into a fluid outlet channel 38'. Again, it should be understood that anticipated by this disclosure is the combination of fourth microchannels 36' and fluid outlet channel 38', thereby providing for few component structures within device 10'. Similar to the previously described embodiment, in this embodiment second microchannels 22' of first ball check valve 14' and third microchannels 34' of second ball check valve 30' are formed to prevent the blockage of microchannels 22' and 34' by a ball (described presently) encompassed therein cavities 20' and 32'.

The previously described pluraltiy of microchannels are formed in the plurality of ceramic layers 12' so as to three-dimensionally integrate the microchannel functions. More specifically, ceramic layers 12' are comprised of a composite of any powdered ceramic material dispersed in an organic binder, normally a thermal plastic. This organic binder provides the starting "green sheet" material which can be handled much like a sheet of paper. Microchannels 16', 18', 22', 24', 34', 36', and 38', and cavities 20' and 32' are formed by mechanically punching or laser drilling into each individual ceramic layer 12' to define these areas. It should additionally be understood that emerging technologies can be utilized to form these internal structures into ceramic layers 12', such as through the use of fugitive materials thereby forming the internal cavities and channels. During fabrication, a first cofired ball 40' is placed within inlet fluid cavity 20', and a second cofired ball 42' is placed within outlet fluid cavity 32'.

First and second cofired balls 40' and 42' in this particular embodiment are formed approximately 5–80 mils in diameter, with a preferred diameter of approximately 20 mils. First and second cofired balls 40' and 42' are formed of a magnetic material that is stable to chemical reactions at 900° C., thereby remaining unaffected by the sintering process (discussed presently). Materials suitable for First and second cofired balls 40' and 42' are stainless steel, a permanent magnet material, or the like. First and second cofired balls 40' and 42' are fabricated to provide for a surface area having minimal contact between the surface of first cofired ball 40' and the surfaces of cavity 20', and the surface of second cofired ball 42' and the surfaces of cavity 32'.

As illustrated, cavities 20' and 32' are formed in ceramic layers 12' to define a three-dimensional pyramid-like structure within ceramic layers 12', and more particularly package 13'. The three-dimensional pyramid-like structure is desired to provide for the movement of first cofired ball 40' within a neck portion 21' of cavity 20' and movement of second cofired ball 42' within a neck portion 33' of cavity 32' thereby stopping the flow of fluid through cavities 20' and 32', and thus micropump 10'. This provision to allow for the movement of first and second cofired balls 40' and 42' within cavities 20' and 32' respectfully, provides for one aspect of the operational portion of ball check valves 14' and 30' of micropump 10'.

In addition, in this particular embodiment, a plurality of valve control coils, more particularly a first valve control coil 48 and a second valve control coil 50 are positioned relative to first and second cofired balls 40' and 42' and cavities 20' and 32', respectively, to provide control of first ball check valve 14' and second ball check valve 30'. Valve control coils 48 and 50 are formed of a material capable of creating an electromagnetic field about first and second cofired balls 40' and 42' when under the influence of a voltage. In this particular embodiment, valve control coils 48 and 50 are formed of a metal, such as gold (Au), silver (Ag), platinum (Pt), or combinations thereof.

Once first and second cofired balls 40' and 42' are positioned respectively into cavity 20' and cavity 32' having valve control coils 48 and 50 positioned relative thereto, the plurality of ceramic layers 12' are laminated together to form package 13'. Typically, each layer is inspected prior to this laminating process. A low pressure lamination process is used on the stack of processed ceramic layers without collapsing channels 16', 18', 22', 24', 34', 36', and 38', and cavities 20' and 32' formed in ceramic layers 12'. This laminating process forms a monolithic structure. Next, the monolithic structure is fired, or sintered, at a temperature that is less than the temperature at which first and second cofired balls 40' and 42' become unstable. More specifically, sintering at a temperature of approximately 850–900° C. is performed, whereby the organic materials are volatilized and the monolith becomes a three-dimensional functional ceramic package. It should be understood that balls 40' and 42' are cofired with the ceramic layers 12', and that no separate firing step is required prior to the placement of first and second cofired balls 40' and 42' within cavities 20' and 32', respectively. Subsequent to the sintering process, first and second cofired balls 40' and 42' remain separate from cavities 20' and 32', and are therefore capable of movement within cavities 20' and 32' as described herein, during operation of micropump 10'.

There is included as a part of micropump 10', an actuator 44' which provides for the pumping action of micropump 10'. Similar to the embodiment described with respect to FIG. 1, in this embodiment, actuator 44' is described as a piezoelectric actuation element 45, being either unimorph or bimorph in design. Operation of micropump 10' occurs with the actuation of piezoelectric actuation element 45' when under the influence of a voltage. More specifically, during operation a first power source (not shown) provides for driving power to piezoelectric actuation element 45' which causes element 45' to move up and down, thereby forcing fluid through pump 10' in a manner generally similar to that described with respect to FIG. 1. A second power source (not shown) provides for driving power to valve control coils 48 and 50. When a voltage is generated and applied to coil 48, first cofired ball 40' is moved by an electromagnetic force generated by coil 48 onto first cofired ball 40' into neck portion 21' of cavity 20', thereby closing valve 14' and forcing fluid through outlet channel 38'. When a voltage is generated and applied to coil 50, second cofired ball 42' is forced into neck portion 33' of cavity 32', thereby closing valve 30' and thus pulling fluid through inlet channel 16'.

This pumping action provides for the movement, or forcing, of fluid through micropump 10'. It should be understood that in this particular embodiment, coils 48 and 50 are controlled by independent power sources other than that for piezoelectric actuator 45, hence the need for a first and second power source. However, the driving powers from the multiple power sources should be synchronized to control the actuation of piezoelectric actuator 45 and coils 48 and 50 to maximize the flow rate. In addition, it is anticipated by this disclosure that valve control coils 48 and 50 can be operated to open and close first ball check valve 14 and second ball check valve 30 independent of fluid flow. As described, micropump 10' operates with the inclusion of active valves, in that the movement of first and second cofired balls 40' and 42' within cavities 20' and 32', respectively, are independent upon the movement of fluid through the plurality of channels. The movement of first and second cofired balls 40' and 42' are dependent upon a voltage applied to coils 48 and 50, thereby generating an electromagnetic field which causes a responsive movement of first and second cofired balls 40' and 42'. Micropump 10' is self-priming and could in principle pump air.

Accordingly, described is a micropump including a plurality of ball check valves integrated into a plurality of ceramic layers, thereby forming a ceramic package. The ceramic package provides for the pumping of fluids therethrough. The micropump is formed including either passive valves in which the valve function is dependent upon the flow of liquid therethrough, or active valves in which valve function is independent upon the flow of liquid therethrough, and operational based on the inclusion of a plurality of valve control coils.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A multilayer ceramic micropump comprising:

a multilayer ceramic package defining an integrated first ball check valve, and an integrated second ball check valve, the first ball check valve and the second ball check valve in microfluidic communication; and an actuator characterized as actuating a pumping motion, thereby pumping fluids through the first ball check valve and the second ball check valve.

2. A multilayer ceramic micropump as claimed in claim 1 wherein the multilayer ceramic package includes a plurality of sintered ceramic layers, having defined therein the first ball check valve, and the second ball check valve, the first ball check valve and the second ball check valve, and a plurality of microchannels in microfluidic communication with the first ball check valve and the second ball check valve.

3. A multilayer ceramic micropump as claimed in claim 2 wherein the first ball check valve includes a fluid inlet channel, an inlet fluid cavity, and a first cofired ball positioned within the inlet fluid cavity and the second ball check valve includes a fluid outlet channel, an outlet fluid cavity and a second cofired ball positioned within the outlet fluid cavity.

4. A multilayer ceramic micropump as claimed in claim 3 wherein the inlet fluid cavity and the outlet fluid cavity each define a pyramid-like structure defining a neck portion.

5. A multilayer ceramic micropump as claimed in claim 4 wherein the first cofired ball and the second cofired ball are formed of a material that is stable at a temperature of at least 900° C.

6. A multilayer ceramic micropump as claimed in claim 5 wherein the first cofired ball and the second cofired ball are formed of one of a ceramic material, a stainless steel material, or a permanent magnetic material.

7. A multilayer ceramic micropump as claimed in claim 6 wherein the actuator is a piezoelectric actuator element.

8. A multilayer ceramic micropump as claimed in claim 7 further including a plurality of valve control coils, positioned proximate the inlet fluid cavity and the outlet fluid cavity, thereby providing for the exertion of an electromagnetic force upon the first cofired ball and the second cofired ball.

9. A multilayer ceramic micropump comprising:

a multilayer ceramic package having integrated therein a first ball check valve, and a second ball check valve in microfluidic communication with the first ball check valve; and a plurality of integrated valve control coils characterized as actuating an electromagnetic field upon the first ball check valve and the second ball check valve, thereby providing for the pumping of a fluid through the first ball check valve and the second ball check valve.

10. A multilayer ceramic micropump as claimed in claim 9 wherein the multilayer ceramic package is formed of a plurality of sintered ceramic layers, having defined therein the first ball check valve, and the second ball check valve, and a plurality of microchannels in microfluidic communication with the first ball check valve and the second ball check valve.

11. A multilayer ceramic micropump as claimed in claim 10 wherein the first ball check valve includes a fluid inlet channel, an inlet fluid cavity, and a first cofired ball positioned within the inlet fluid cavity and the second ball check valve includes a fluid outlet channel, an outlet fluid cavity and a second cofired ball positioned within the outlet fluid cavity.

12. A multilayer ceramic micropump as claimed in claim 11 wherein the inlet fluid cavity and the outlet fluid cavity each define a pyramid-like structure defining a neck portion.

13. A multilayer ceramic micropump as claimed in claim 12 wherein the first cofired ball and the second cofired ball are formed of a permanent magnetic material.

14. A multilayer ceramic micropump as claimed in claim 13 further including an actuator element, positioned to provide for a pumping force upon a liquid contained within the first ball check valve and the second ball check valve.

* * * * *